US007202786B2

(12) United States Patent
Marszalek et al.

(10) Patent No.: US 7,202,786 B2
(45) Date of Patent: Apr. 10, 2007

(54) APPARATUS, A SYSTEM AND A METHOD FOR SECURING AND/OR FOR MONITORING A DEVICE

(75) Inventors: Christopher Marszalek, Plainfield, IL (US); Daniel Horvath, Marseilles, IL (US); Sorin Petrusan, Chicago, IL (US); Peter Passuntino, Wheaton, IL (US)

(73) Assignee: Sennco Solutions, Inc., Plainfield, IL (US)

( * ) Notice: Subject to any disclaimer, the term of this patent is extended or adjusted under 35 U.S.C. 154(b) by 225 days.

(21) Appl. No.: 10/853,412

(22) Filed: May 25, 2004

(65) Prior Publication Data

US 2005/0264418 A1 Dec. 1, 2005

(51) Int. Cl.
*G08B 13/12* (2006.01)

(52) U.S. Cl. ..... 340/568.3; 340/568.4; 340/506

(58) Field of Classification Search ..... 340/568.2–4, 340/508, 509

See application file for complete search history.

(56) References Cited

U.S. PATENT DOCUMENTS

| | | | | |
|---|---|---|---|---|
| 4,896,140 | A | 1/1990 | Biever et al. | |
| 5,066,942 | A | 11/1991 | Matsuo | |
| 5,072,213 | A | 12/1991 | Close | |
| 5,124,685 | A | 6/1992 | Rankin | |
| 5,172,098 | A | 12/1992 | Leyden et al. | |
| 5,552,771 | A | 9/1996 | Leyden et al. | |
| 5,565,848 | A | 10/1996 | Leyden et al. | |
| 6,027,277 | A | 2/2000 | Leyden et al. | |
| 6,039,498 | A | 3/2000 | Leyden et al. | |
| 6,087,939 | A | 7/2000 | Leyden et al. | |
| RE37,590 | E | 3/2002 | Leyden et al. | |
| 6,707,284 | B2 * | 3/2004 | Lanni | 323/297 |
| 6,756,900 | B2 * | 6/2004 | Leyden et al. | 340/568.4 |

FOREIGN PATENT DOCUMENTS

| | | | |
|---|---|---|---|
| GB | 2 128 790 | A | 5/1984 |

* cited by examiner

*Primary Examiner*—Jeffery Hofsass
*Assistant Examiner*—Hongmin Fan
(74) *Attorney, Agent, or Firm*—Patents +TMS, P.C.

(57) ABSTRACT

An apparatus, a system and a method secures and/or monitors a device. Additionally, the apparatus, the system and the method attach and/or secure the device to a fixture. The device is connected to an alarm box, an alarm board and/or a power source. The alarm box and/or the alarm board communicates with a sensor via a cable. The power source communicates with a micro-controller via the cable. A programmable logical device controls a voltage from the power source and/or a programmable power supplier to the device. Moreover, a first LED and/or a second LED indicate that the voltage is provided to the device and that the alarm box has been activated. The cable extends outward with respect to a base allowing the device to be manipulated, to be examined and/or to be utilized by a customer and/or a user without triggering the alarm box.

19 Claims, 4 Drawing Sheets

APPARATUS, A SYSTEM AND A METHOD FOR SECURING AND/OR FOR MONITORING A DEVICE

BACKGROUND OF THE INVENTION

The present invention generally relates to an apparatus, a system and a method for securing and/or for monitoring a device. More specifically, the present invention relates to an apparatus, a system and a method for securing and/or for monitoring a portable device, such as, for example, a camera, a digital camera, a compact disc player, a MP3 player, a personal data assistant (hereinafter "a PDA"), a laptop computer, a cellular telephone and/or the like. The apparatus, the system and the method for securing and/or for monitoring the device may attach the device to a fixture to prevent theft of and/or destruction of the device. The device may be a portable device which may be, for example, displayed for sale by a retailer, a wholesaler and/or the like.

The apparatus, the system and the method for securing and/or for monitoring the device may have a sensor board attached to the device. The sensor board may have a first micro-controller and/or an optical sensor. The sensor board may be connected to a power supply board via a cable. The power supply board may have an alarm box, an alarm board and/or a power source. Further, the alarm box and/or the alarm board may be in communication with the optical sensor on the sensor board via the cable. The optical sensor may monitor and/or may detect a pin in the sensor board which may activate the alarm box. Still further, the power source may be in communication with and/or may be controlled by the first micro-controller on the sensor board via the cable. In the alternative, a second micro-controller and/or a programmable power supplier may be in communication with the power source. The second micro-controller and/or the programmable power supplier may control a voltage from the power source to the device. Moreover, the sensor board may have a first light emitting diode (hereinafter "LED") and/or a second LED which may indicate when power is provided to the device and may indicate when the alarm box has been activated, respectively.

It is generally known, for example, that vendors, retailers and/or wholesalers may display a device to a customer at, for example, a retail store and/or sales facility. The device is a camera, a digital camera, a portable compact disc player, a PDA, a laptop computer and/or a cellular telephone. The device is traditionally displayed in conjunction with a fixture, such as, for example, a cabinet, a table, a shelf and/or the like. A cable attaches the device to the fixture. The device is secured to the fixture by the cable. Often, the cable is not durable to prevent breaking and/or allows the device to be easily separated from the fixture. Additionally, an alarm system is often provided that attaches to the device. Often, a second wire is required to attach the alarm system to the device.

Additionally, a power cable is connected to the device to supply a voltage to the device. Each device requires a specific voltage, such as, for example, five volts to operate without damaging the device. Often, the power cable contains pairs of electrical wires which attach directly to the device. However, each pair of electrical wire is only capable of delivering a single voltage, such as, for example, three volts, five volts or seven volts. Therefore, only one pair of electrical wires provide the specific voltage required by the device. As a result, different pairs of electrical wires must be provided and/or utilized with each device which requires a different voltage. Having to attach a different pair of wires to each device is inconvenient and/or is burdensome.

Furthermore, the cables which secure the device often prevent a customer and/or a user from manipulating and/or examining the device. The device is often fixed to a surface of the fixture. Accordingly, the customer and/or the user may not be able to pick up and/or to move the device to examine the device, such as, to examine various characteristics of the device for example, the weight, the texture, the feel, the configuration of the device and/or the like. A longer cable incorporated with the device and/or the fixture allows the customer and/or the user to examine the device. However, the longer cable is impractical and/or tangles with other cables and/or the device or other devices. Furthermore, the customers and/or the user having disabilities are prevented from moving the device to a location which allows for examination and/or inspection of the device.

A need, therefore, exists for an apparatus, a system and a method for securing and/or for monitoring a device. Additionally, a need exists for an apparatus, a system and a method for securing and/or for monitoring a device which may provide mechanical security and electrical security to the device. Further, a need exists for an apparatus, a system and a method for securing and/or for monitoring a device which may visibly indicate that the device is mechanically secured and/or is electrically secured. Still further, a need exists for an apparatus, a system and a method for securing and/or for monitoring a device which may allow the device to be moved from a surface of a fixture and/or examined by customers and/or by users. Moreover, a need exists for an apparatus, a system and a method for securing and/or for monitoring a device which may trigger an alarm when the device is separated from the system. Furthermore, a need exists for an apparatus, a system and a method for securing and/or for monitoring a device which may provide a voltage from a power source to the device corresponding to a required operational voltage of the device.

SUMMARY OF THE INVENTION

The present invention relates to an apparatus, a system and a method for securing and/or for monitoring a portable device, such as, for example, a camera, a digital camera, a compact disc player, a MP3 player, a PDA, a laptop computer, a cellular telephone and/or the like. Further, the apparatus, the system and the method for securing and/or for monitoring the device may attach and/or may secure the device to a fixture, such as, for example, a cabinet, a table, a shelf and/or the like. Still further, the apparatus, the system and the method for securing and/or for monitoring the device may have a sensor board connecting the device to an alarm box, an alarm board and/or a power source. The alarm box and/or the alarm board may be in communication with an optical sensor on the sensor board via a cable. A micro-controller and/or a programmable power supplier may control a voltage which may be delivered from the power source to the device. The sensor board may have a first light emitting diode (hereinafter "LED") and/or a second LED which may indicate when power is provided to the device and may indicate when the alarm box and/or alarm board has been activated, respectively. The cable may be extended outward with respect to a base which may allow the device to be manipulated and/or to be examined by a customer and/or a user.

To this end, in an embodiment of the present invention, an apparatus for securing a device is provided. The apparatus has a connector having walls defining an interior wherein the connector attaches to the device to provide electrical power to the device. Further, the apparatus has a controller connected to the device wherein the controller is within the interior of the connector and further wherein the controller is in communication with the device. Still further, the apparatus has a sensor in communication with the controller wherein the sensor is within the interior of the connector. Moreover, the apparatus has an alarm in communication with the controller wherein the sensor communicates with the alarm via the controller. Furthermore, the apparatus has a pin sensed by the sensor wherein the sensor detects a position of the pin and activates the alarm in response to a change in the position of the pin.

In an embodiment, the apparatus has a light emitting diode in communication with the controller.

In an embodiment, the apparatus has a passage in the wall of the connector wherein the pin extends through the passage.

In an embodiment, the apparatus has a cable connecting the controller to the alarm.

In another embodiment of the present invention, a system for monitoring a device wherein the device is secured to a fixture is provided. The system has a base having an interior and a first controller attached to an alarm and a power source wherein the first controller communicates with the alarm and the power source. Further, the system has an attaching means connecting the device to the first controller wherein the attaching means extends from the first controller through the base to the device wherein the attaching means provides electrical power from the power source to the device. Moreover, the system has a sensor detecting a condition between the attaching means and the device wherein the sensor activates the alarm via the first controller.

In an embodiment, the base is attached to the fixture.

In an embodiment, the attaching means is a cable.

In an embodiment, the system has a pulley in the interior of the base.

In an embodiment, the system has a second controller connecting the device to the first controller.

In an embodiment, the system has a pin detected by the sensor.

In an embodiment, the system has a monitor in communication with the device.

In another embodiment of the present invention, a method for monitoring a secured condition of a device wherein the device requires a voltage is provided. The method has the step of providing a first controller having an alarm and a power source wherein the power source provides the voltage to the device. Further, the method has the step of providing a second controller that communicates with the device wherein the second controller provides the voltage to the device from the power source and further wherein the first controller is remotely positioned from the second controller. Moreover, the method has the step of activating the alarm wherein the second controller senses a breach of the secured condition and signals the first controller.

In an embodiment, the method has the step of providing an external sensor to communicate with the second controller.

In an embodiment, the method has the step of providing a monitor in communication with the device.

In an embodiment, the method has the step of programming the second controller with a voltage necessary to power the device.

In an embodiment, the method has the step of communicating the voltage required to operate the device from the device to the first controller via the second controller.

In an embodiment, the method has the step of indicating that the second controller is in communication with the first controller.

In an embodiment, the method has the step of transmitting a signal from the device to the first controller.

In another embodiment of the present invention, an apparatus for extending a cable wherein the cable has a continuous length defined between a first end and a second end opposite to the first end is provided. The apparatus has a fixed end and a movable end wherein the fixed end is remotely positioned from the movable end wherein the first end of the cable is secured to the fixed end and further wherein the cable extends between the fixed end and the movable end. Moreover, the apparatus has a pulley between the fixed end and the movable end wherein the pulley receives the cable and further wherein the pulley guides the second end of the cable outward with respect to the movable end wherein the pulley moves between the fixed end and the movable end.

In an embodiment, the apparatus has a roller between the pulley and the fixed end.

In an embodiment, the second end of the cable extends from the movable end in a direction that is non-parallel to the cable.

In an embodiment, the apparatus has an arm attaching the pulley and the movable end.

In an embodiment, the apparatus has a passage in the fixed end.

In another embodiment of the present invention, a method for extending a cable wherein the cable has a length defined between a first end and a second end is provided. The method has the steps of providing a base having an interior defined between a first end and a second end. Further, the method has the step of providing a pulley in the interior of the base. Moreover, the method has the step of extending the cable from the interior of the base wherein the cable moves the pulley within the interior of the base between the first end and the second end of the base as the length of the cable extends exterior to the base.

In an embodiment, the method has the step of moving the pulley inward with respect to the second end of the base.

In an embodiment, the method has the step of pulling the second end of the cable inward with respect to the interior of the base.

In an embodiment, the method has the step of directing the cable through the interior of the base.

In an embodiment, the method has the step of attaching an arm between the pulley and the second end of the base.

It is, therefore, an advantage of the present invention to provide an apparatus, a system and a method for securing and/or for monitoring a device which may mechanically secure and/or may electrically secure the device.

Another advantage of the present invention is to provide an apparatus, a system and a method for securing and/or for monitoring a device which may attach the device to a fixture.

And, another advantage of the present invention is to provide an apparatus, a system and a method for securing and/or for monitoring a device which may visibly display that the device is mechanically attached to the fixture.

Yet another advantage of the present invention is to provide an apparatus, a system and a method for securing and/or for monitoring a device which may visibly display that an electrical alarm has been activated and/or has been connected to the device.

A further advantage of the present invention is to provide an apparatus, a system and a method for securing and/or for monitoring a device which may be mounted to the device via a mounting hole and/or a tripod hole located on an underside of the device.

Moreover, an advantage of the present invention is to provide an apparatus, a system and a method for securing and/or for monitoring a device which provides a voltage to the device corresponding to a required operational voltage of the device.

And, another advantage of the present invention is to provide an apparatus, a system and a method for securing and/or for monitoring a device which provides a voltage between two volts and fifteen volts to the device.

Yet, another advantage of the present invention is to provide an apparatus, a system and a method for securing and/or for monitoring a device which provides a cable attaching the device to a surface.

Another advantage of the present invention is to provide an apparatus, a system and a method for securing and/or for monitoring a device which provides a pulley between the device and a surface.

Yet another advantage of the present invention is to provide an apparatus, a system and a method for securing and/or for monitoring a device which allows the device to be removed from the surface of the fixture and/or examined by a customer and/or a user.

A still further advantage of the present invention is to provide an apparatus, a system and a method for securing and/or for monitoring a device which allows the device to be moved from the fixture to a length of three feet or less.

Moreover, an advantage of the present invention is to provide an apparatus, a system and a method for securing and/or for monitoring a device which provides a micro-controller and/or programmable power supplier in communication with a power source.

And, another advantage of the present invention is to provide an apparatus, a system and a method for securing and/or for monitoring a device which provides electrical security and/or mechanical security with a cable attached to the device.

Yet another advantage of the present invention is to provide an apparatus, a system and a method for securing and/or for monitoring a device which provides an LED indicating the device is mechanically secured and/or is electrically secured.

A further advantage of the present invention is to provide an apparatus, a system and a method for securing and/or for monitoring a device which provides mechanical security with an cable connecting the device to the fixture.

Moreover, an advantage of the present invention is to provide an apparatus, a system and a method for securing and/or for monitoring a device which provides an optical sensor in communication with an alarm box.

A still further advantage of the present invention is to provide an apparatus, a system and a method for securing and/or for monitoring a device which provides video signal wires for transmitting video signals from the device to a monitor.

Yet another advantage of the present invention is to provide an apparatus, a system and a method for securing and/or for monitoring a device which provides a pulley and/or a roller for controlling a distance between the device and the fixture.

A still further advantage of the present invention is to provide an apparatus, a system and a method for securing and/or for monitoring a device which provides an optical sensor and a pin activating the alarm box.

Moreover, an advantage of the present invention is to provide an apparatus, a system and a method for securing and/or for monitoring a device which provides a programmable power supplier to send a voltage to the device And, another advantage of the present invention is to provide an apparatus, a system and a method for securing and/or for monitoring a device which provides an LED indicating that a voltage has been sent to the device Yet another advantage of the present invention is to provide an apparatus, a system and a method for securing and/or for monitoring a device which provides an internal sensor for detecting an external sensor.

A further advantage of the present invention is to provide an apparatus, a system and a method for securing and/or for monitoring a device which provides mechanical and/or electrical security for a more than one device.

Moreover, an advantage of the present invention is to provide an apparatus, a system and a method for securing and/or for monitoring a device which provides programmable logical device to control a voltage delivered from a power source to the device.

And, another advantage of the present invention is to provide an apparatus, a system and a method for securing and/or for monitoring a device which allows a required operational voltage of the device to be programmed into and/or delivered by a micro-controller.

Additional features and advantages of the present invention are described in, and will be apparent from, the detailed description of the presently preferred embodiments and from the drawings.

DETAILED DESCRIPTION OF THE PREFERRED EMBODIMENTS

The present invention relates to an apparatus, a system and a method for securing and/or for monitoring a device. The apparatus, the system and the method for securing and/or for monitoring the device may attach and/or may secure the device to a fixture. Further, the apparatus, the system and the method for securing and/or for monitoring the device may have a sensor board connecting the device to an alarm box, an alarm board and/or a power source. The alarm box and/or the alarm board may be in communication with an optical sensor on the sensor board via a cable. The power source may be in communication with a first micro-controller on the sensor board via the cable. A second micro-controller may control a voltage which may be delivered from the power source and/or a programmable power supplier to the device. Moreover, the sensor board may have a first LED and/or a second LED which may indicate that power is provided to the device and may indicate that the alarm box and/or the alarm board is activated, respectively. Furthermore, the cable may extend outward with respect to a base which may allow the device to be manipulated and/or to be examined by a customer and/or a user.

Figure 1:
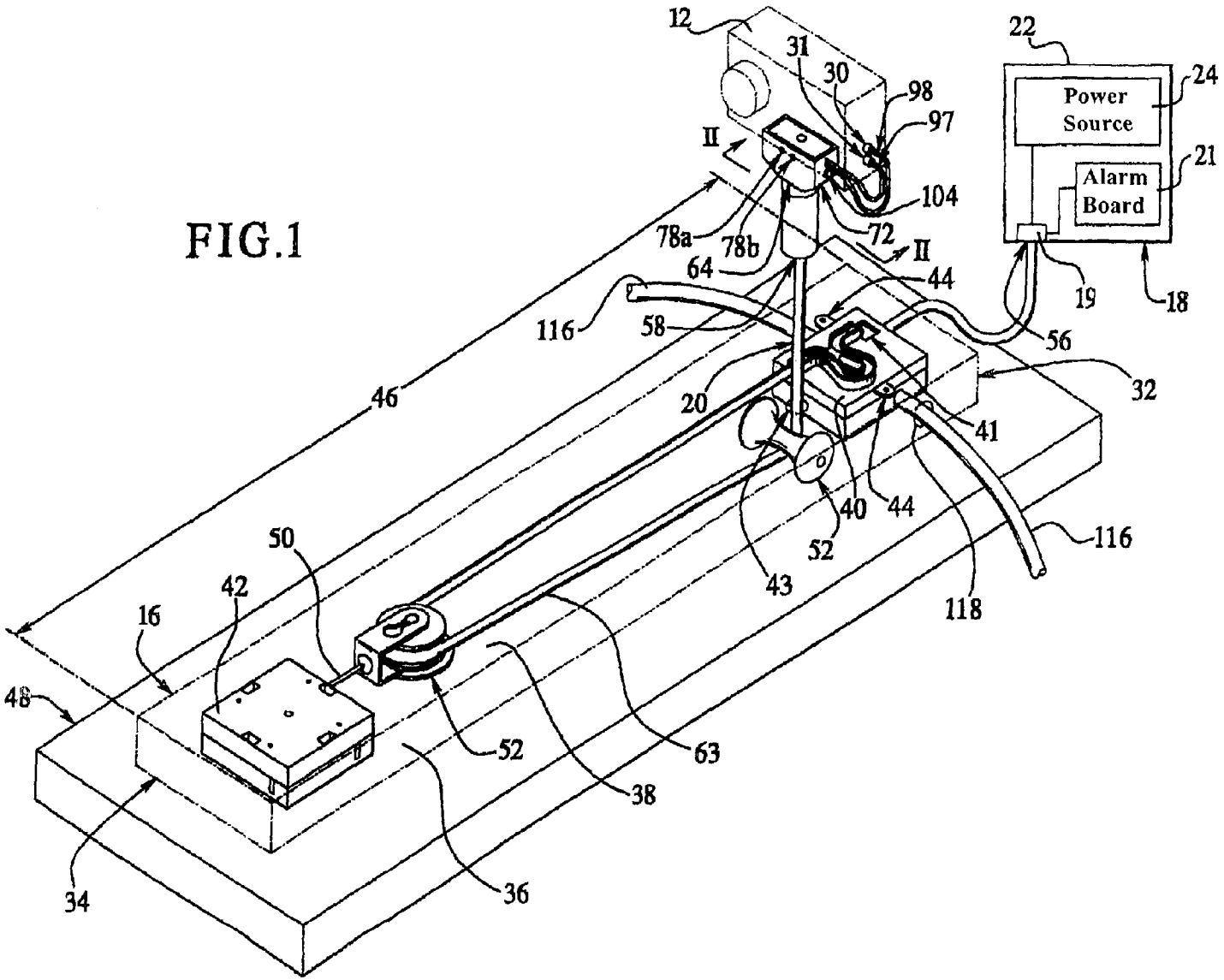
FIG. 1 is a perspective view of a device mounted to a system in an embodiment of the present invention.
Figure 2:
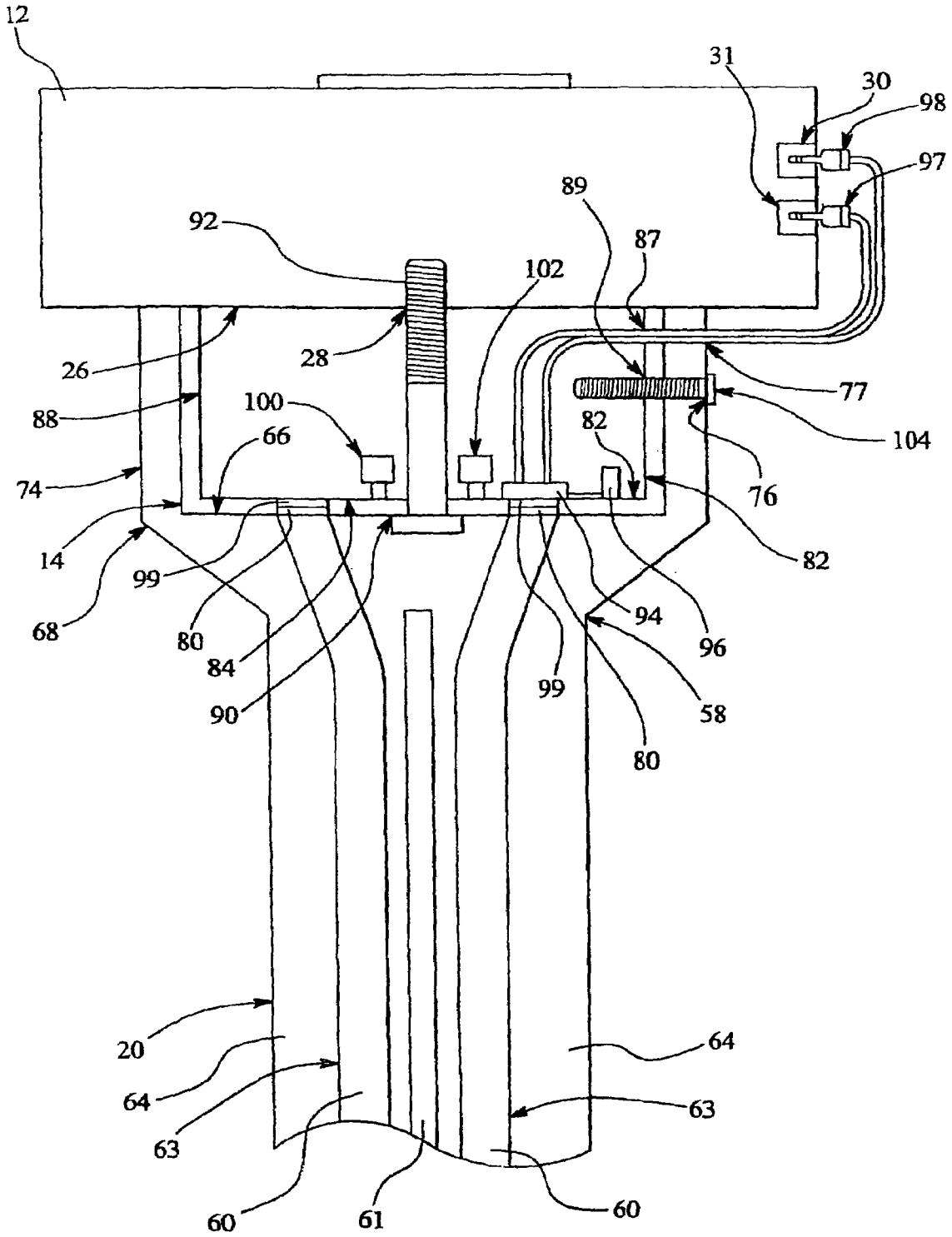
FIG. 2 is a cross-sectional view of the device mounted to a sensor board and a cable of the system in FIG. 1 as taken along line II—II in an embodiment of the present invention.

Referring now to the drawings wherein like numerals refer to like parts, FIGS. 1 and 2 illustrate a system 10 which may have a device 12 mounted to a sensor board 14. The device 12 and/or the sensor board 14 may be connected to the base 16 and/or a alarm box 22 via a cable 20. The alarm box 22 may contain an alarm connector 19, an alarm board 21 and/or a power source 24. The power source 24 may plug into a wall socket (not shown) to provide the power source 24 with an incoming voltage, such as, for example, 110 volts and/or an incoming current, such as, for example, an alternating current.

The device 12 may be a portable device, such as, for example, a camera, a digital camera, a compact disc player, a MP3 player, a PDA, a laptop computer, a cellular telephone and/or the like. Further, the device 12 may have an underside 26 and/or a mounting hole 28. The mounting hole 28 may be adapted to receive, for example, a screw from a tripod mount. As a result, the device 12 may be mounted on a tripod.

The device 12 may have a direct current plug-in 30 (hereinafter "DC plug-in 30") and/or a video out-line 31. The video out-line 31 may transmit video signals generated by the device 12 to, for example, a video monitor 112 and/or the like. The device 12 may require an operating voltage, such as, for example, three volts, five volts and/or the like. Each type of portable device may require a specific operating voltage. For example, a portable compact disc player may have an operating voltage of 4.5 volts, a cellular telephone may have an operating voltage of seven volts and a digital camera may have an operating voltage of six volts. Further, the device 12 may require an operating current, such as, for example, a direct current. Moreover, the present invention should not be deemed as limited to the embodiments of a specific portable device and/or a specific operating voltage of the device 12.

The base 16 may have a length 46 between a first end 32 and a second end 34. Further, the base 16 may have an interior 38 and an exterior 36. Still further, the base 16 may have a fixed end 40 and a movable end 42 which may be adjacent to the first end 32 and the second end 34, respectively. A pair of mounts 44 may attach the fixed end 40 to the interior 38 of the base 16. The movable end 42 may move between the fixed end 40 and the second end 34 within the interior 38 of the base 16. The first end 32 may have a first opening 41. A second opening 43 may be located between the first end 32 and the second end 34. The first opening 41 and/or the second opening 43 may extend from the interior 38 to the exterior 36 of the base 16. The length 46 may be, for example, two feet. Moreover, the base 16 and/or the exterior 36 of the base 16 may be attached to and/or may be mounted to a fixture 48. The fixture 48 may be, for example, a table, a cabinet, a shelf and/or the like. The present invention should not be deemed as limited to the embodiments of a specific length 46 and/or a specific fixture 48.

Figure 3:
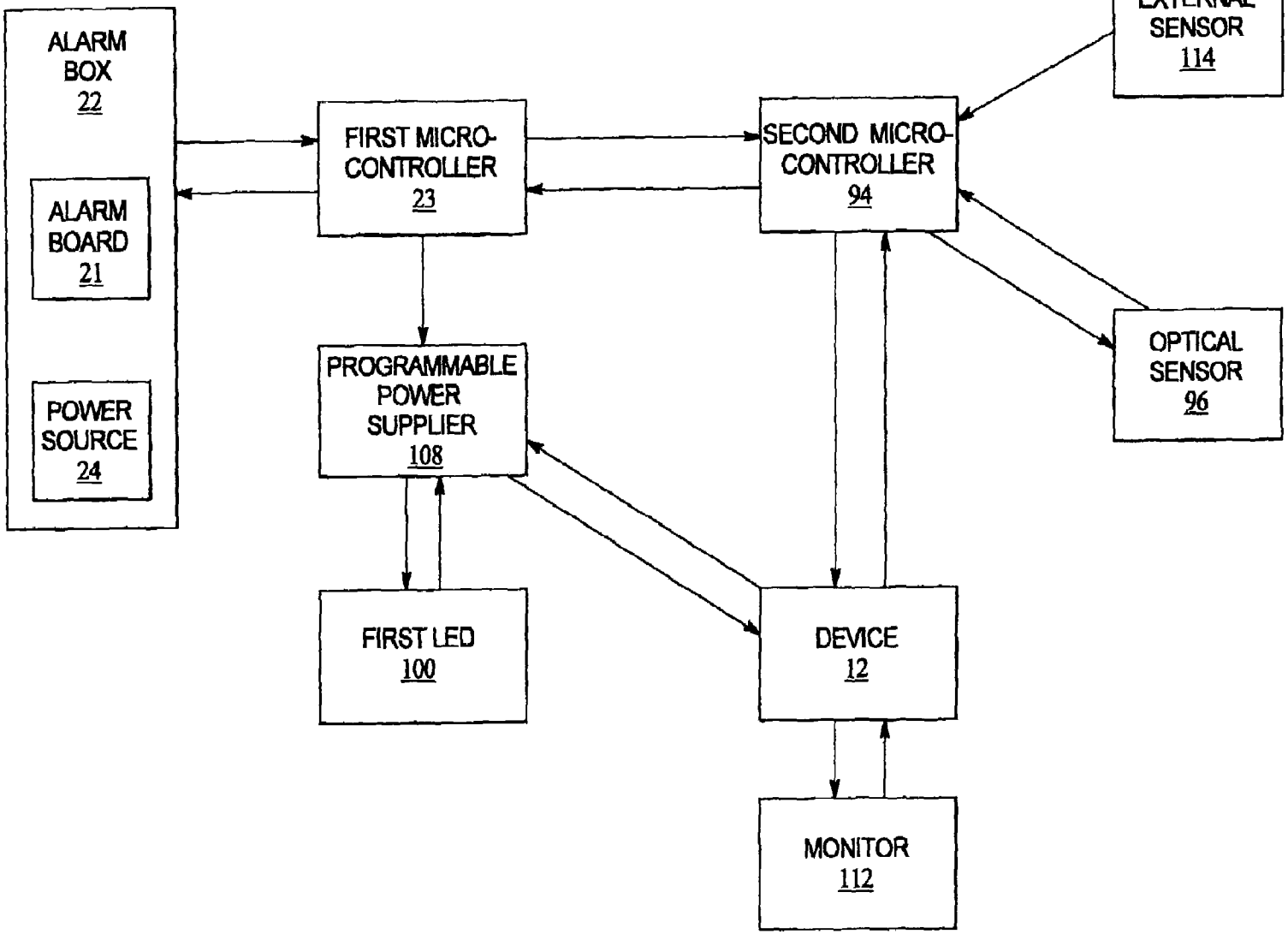
FIG. 3 is a black box diagram of a system in an embodiment of the present invention.
Figure 4:
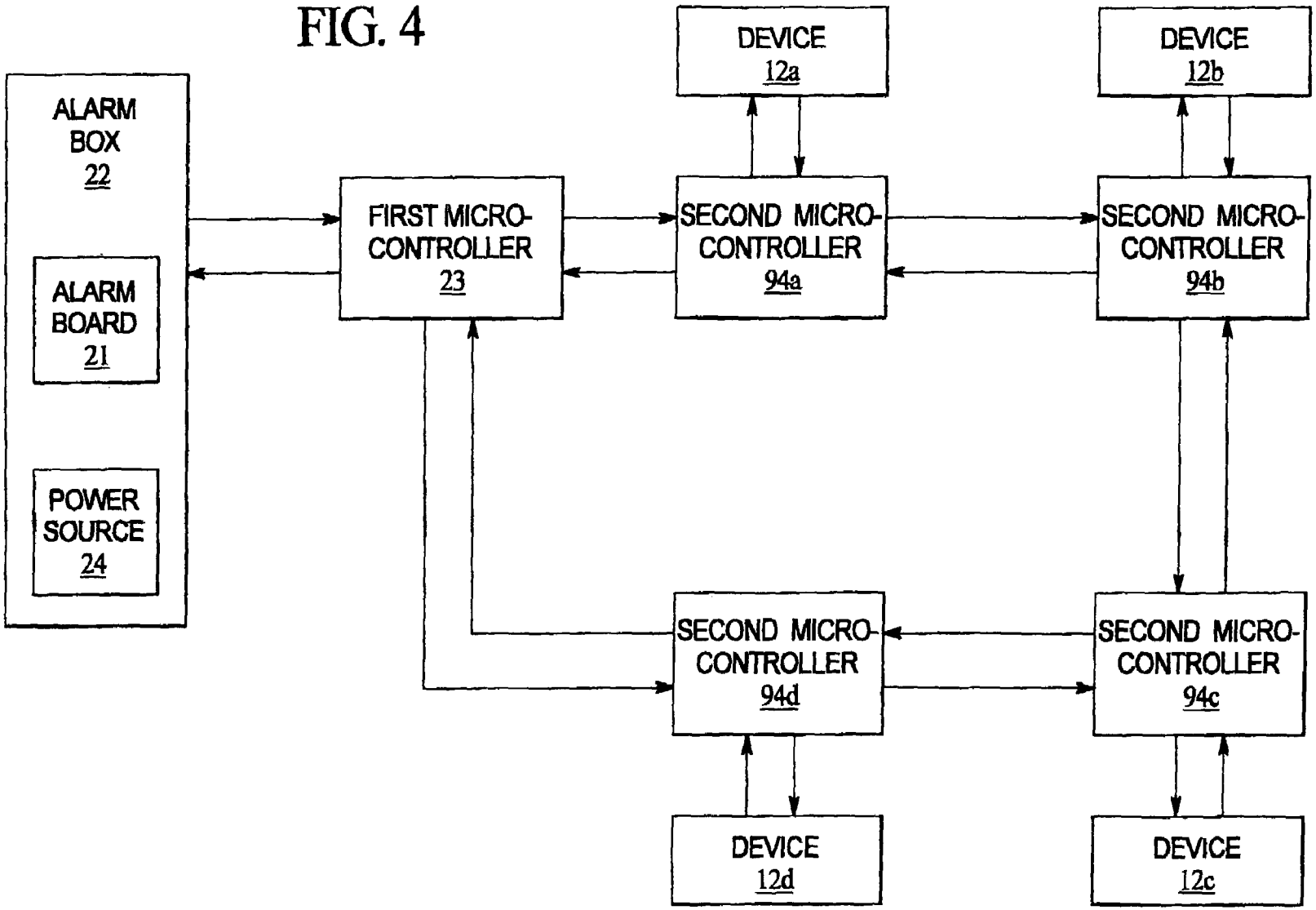
FIG. 4 is a black box diagram of a system in an embodiment of the present invention.

As illustrated in FIGS. 1, 3 and 4, the fixed end 40 may contain a programmable power supplier 108 and/or a programmable logical device, such as, for example, a first micro-controller 23. The alarm connector 19 may connect the first micro-controller 23 and/or the programmable power supplier 108 to the alarm box 22, the alarm board 21 and/or the power source 24. The first micro-controller 23 may control the programmable power supplier 108. The programmable power source 108 may convert the incoming current from the power source 24 to, for example, a direct current. Still further, the first micro-controller 23 may control an output voltage of the programmable power source 108. The programmable power source 108 may provide the output voltage between, for example, two volts and fifteen volts. Moreover, the first micro-controller 23 may control and/or may operate the alarm box 22. The first micro-controller 23 may be programed to provide the required operational voltage to the device 12 from the power source 24 via the programmable power supplier 108 and/or the cable 20.

The movable end 42 may have an arm 50 extending inward with respect to the fixed end 40. A pulley 52 may be attached to the arm 50 in a position opposite to the movable end 42. A roller 54 may be located within the interior 38 of the base 16. The roller 54 may be adjacent to the fixed end 40 of the base 16. Moreover, the pulley 52, the roller 54 and/or the arm 50 may be located between the movable end 42 and the fixed end 40 of the base 16.

The cable 20 may extend from the first micro-controller 23 to an end 58. Further, the cable 20 may have a plurality of electrical wires 60 and/or a mechanical cable 61. The plurality of electrical wires 60 and/or the mechanical cable 61 may extend from the first micro-controller 23 to the end 58. The mechanical cable 61 may be made from a material, such as, for example, steel and/or the like.

The plurality of electrical wires 60 may provide a number of electrical pathways between the first micro-controller 23 and the end 58 of the cable 20. The number of electrical pathways may be determined by a number of electrical signals being communicated between the first micro-controller 23 and a second micro-controller 94. For example, the plurality of electrical wires 60 may provide, for example, three electrical pathways, such as, for example, a voltage pathway, a video-signal pathway and an alarm signal pathway between the first micro-controller 23 and the second micro-controller 94. The plurality of electrical wires 60 may transmit, for example, power, a communication signal, a video-signal, and/or an audio-signal between the first micro-controller 23 and the second micro-controller 94. Further, the plurality of electrical wires 60 may transmit, for example, power from the programmable power supplier 108 to the device 12. Still further, the plurality of electrical wires 60 may transmit, for example, a video-signal and/or an audio-signal from the device 12 to the video monitor 112. The plurality of electrical wires 60 may be made from a material, such as, for example, copper and/or the like. The present invention should not be deemed as limited to the embodiments of a specific material of the mechanical wire 61 or a specific number of electrical pathways provided by the plurality of electrical wires 60.

As illustrated in FIGS. 1 and 4, the fixed end 40 may have a connector cable 116 extending outward from the exterior 36 of the base 16 via a side hole 118. The connector cable 116 may connect the alarm box 22, the alarm board 21 and/or the power source 24 to the first micro-controller 23 and/or a plurality of second micro-controllers 94*a*, 94*b*, 94*c*, 94*d*. The connector cable 116 may be attached to the alarm box 22 via the alarm connector 19. The connector cable 116 may connect a number, such as, for example, four, eight, twelve or twenty of the second micro-controllers 94 to the alarm box 22, the alarm board 21 and/or the power source 24. The plurality of second micro-controllers 94*a*, 94*b*, 94*c*, 94*d* may be connected to a plurality of devices 12*a*, 12*b*, 12*c*, 12*d*, respectively. Furthermore, it should be understood that the alarm box 22, the alarm board 21 and/or the power source 24 may be in communication with any number of the devices 12, the sensor boards 14, the bases 16, the first micro-controllers 23, the programmable power suppliers 108 and/or the cables 20.

A supply cable 56 may connect the alarm box 22, the alarm board 21 and/or the power source 24 to the first micro-controller 23, the programmable power supplier 108 and/or the cable 20. Further, the supply cable 56 may be attached to the alarm board 21, the alarm box 22 and/or the power source 24 via the alarm connector 19. Still further, the cable 20, the plurality of electrical wires 60 and/or the device 12 may be connected to the alarm box 22 and/or the alarm board 21. The plurality of electrical wires 60 may contain a pair of electrical wires which may be attached to the programmable power supply 108 and/or may deliver a voltage to the device 12. The plurality of wires 60 may contain a pair of communication wires connecting the second micro-controller 94 to the first micro-controller 23. The plurality of wires 60 may contain a pair of video-signaling wires connecting the video out-line 31 of the device 12 to the video monitor 112.

The supply cable 56 may extend through the first opening 41 in the first end 32 of the base 12 to the fixed end 40. The cable 20 may extend through a channel (not shown in the figures) in the fixed end 40. The cable 20 may extend inward with respect to the movable end 42 from the first end 32 of the base 16. The cable 20 may engage the pulley 52 and/or may extend inwards with respect to the first end 32 from the pulley 52. The cable 20 may engage the roller 54 and/or may extend through the second opening 43 in the base 16. The roller 54 may direct the cable in a direction which may be non-parallel to the length 46 between the first end 32 and the second end 34 of the base 16. The cable 20 may extend outward with respect to the interior 38 of the base 16 through the second opening 43 of the base 16 beyond the exterior 36 of the base 16. The end 58 of the cable 20 may be located outside of the base 16 and/or the interior 38 of the base 16. A length (not shown in the figures) of the cable 20 may allow the cable 20 to engage the pulley 52 and the roller 54 and/or may permit the end 58 of the cable 20 to extend outside of the base 16.

The user may apply an outward force with respect to the exterior 36 of the base to the end 58 of the cable 20. As a result, the cable 20 may pull the pulley 52 and/or the movable end 42 inward with respect to the fixed end 40 of the base 16. The pulley 52 and/or the movable end 42 may be pulled by the cable 20 to a position adjacent to the roller 54 and/or the second opening 43. As a result, the end 58 of the cable 20 may be separated from the base 16 by a distance which may correspond to the length 46 of the base 16.

The user may move the end 58 of the cable 20 to a position adjacent to the second opening 43 of the base. The movable end 42 may move outward with respect to the fixed end 40 of the base. The movable end 42 and/or the pulley 52 may move to a position adjacent to the second end 43 of the base 16. As a result, the movable end 42 and/or the pulley 52 may retract the cable 20 inward with respect to the exterior 36 of the base 16. Moreover, the movable end 42 and/or the pulley 52 may retract the end 58 of the cable 20 inward with respect to the exterior 36 of the base 16 to a position which may adjacent to the base 16.

The end 58 of the cable 20 may be attached to a connector 64. The connector 64 may have an interior 66, an exterior 68, a front side 70, a first end 72 and/or a second end 74. The second end 74 may be opposite in location to the first end 72. The first end 72 may have passages 76, 77 that may extend through the first end 72 from the exterior 68 to the interior 66 of the connector 64. The front side 70 may have a first window **78*a* and a second window 78*b*. The first window 78*a* and the second window 78*b* may extend through the front side 70 from the exterior 68 to the interior 66 of the connector 64. Further, the interior 66 of the connector 64 may have a plurality of heads 80. The end 58 of the cable 20 and/or the plurality of electrical wires 60 of the cable 20 may be connected to the plurality of heads 80. Moreover, each of the plurality of heads 80 may correspond to each of the electrical pathways provided by the plurality of electrical wires 60 of the cable 20**.

The sensor board 14 may have a front side 81, a top side 82, a bottom side 84, a first wall 86 and/or a second wall 88. The bottom side 84 may be opposite in location to the top side 82. The second wall 88 may be opposite in location to the first wall 86. Further, the sensor board 14 may have an orifice 90 and/or a fastener 92. The orifice 90 may extend through the sensor board 14 from the bottom side 84 to the top side 82. The fastener 92 may be inserted into the orifice 90 and/or may be inserted into the mounting hole 28 on the underside 26 of the device 12. The fastener 92 may be, for example, a screw. As a result, the fastener 92 may lock into the mounting hole and/or may attach the sensor board 14 to the device 12. The first wall 86 and/or the second wall 88 may be located between the underside 26 of the device 12 and the top side 82 of the sensor board 14. Moreover, the first wall 86 may have passages 87, 89 that may extend through the first wall 86.

The sensor board 14 may have an optical sensor 96 connected to the second micro-controller 94. The bottom side 84 of the sensor board 14 may have a plurality of heads 99 connected to the micro-controller 94. The plurality of heads 99 of the sensor board 14 may correspond with and/or may be connected to the plurality of heads 80 of the connector 64.

The sensor board 14 may have a voltage plug 98 and/or a video in-line 97 extending outward with respect to the first wall 86. The voltage plug 98 may be inserted into the DC plug-in 30 of the device 12 and/or may be connected to the second micro-controller 94 and/or the programmable power supplier 108. The second micro-controller 94 may determine the required operational voltage of the device 12 via the voltage plug 98 and the DC plug-in 30. The second micro-controller 94 may communicate with the device 12 via the voltage plug 98 and the DC plug-in 30 to determine the required operational voltage of the device 12. The micro-controller 94 may communicate the required operational voltage of the device 12 to the first micro-controller 23 via the plurality of electrical wires 60. Moreover, the second micro-controller 94 may be programed to determine the required operational voltage of the device 12, to communicate with the device 12 and/or to communicate the required operational voltage of the device 12 to the microprocessor 23.

The first micro-controller 23 may control the programmable power supplier 108 and/or may adjust the output voltage of the programmable power supplier 108 to the required operational voltage of the device 12. The first micro-controller 23 may deliver the required operational voltage of the device 12 to the second micro-control 94 via the plurality of electrical wires 60. The second micro-control 94 may deliver the required operational voltage of the device 12 to the device 12 via the voltage plug 98 and DC plug-in 30.

In an alternative embodiment, the first micro-controller 94 may be programmed with the required operational voltage of the device 12. The first micro-controller 94 may control the programmable power supplier 108. Further, the programmable power supplier 108 may provide the required operational voltage to the device 12 via the cable 20, the voltage plug 98 and/or the DC plug-in 30.

The front side 81 of the sensor board 14 may have a first light emitting diode 100 (hereinafter "first LED 100") and/or a second light emitting diode 102 (hereinafter "second LED 102"). The second micro-controller 94 may be connected to the second LED 102. The programmable power supplier 108 may be connected to and/or may control the first LED 100. Still further, the second micro-controller 94 may control the second LED 102. The first LED 100 may emit a color, such as, for example, green. The programmable power supplier 108 and/or the first micro-controller 23 may activate the first LED 100 to indicate that the voltage is being supplied to the device 12. The second LED 102 may emit a color, such as, for example, red. However, the present invention should not be deemed as limited to the color of the plurality of the first LED 100 and/or the second LED 102. The second micro-controller 94 may be programmed to control the second LED 102.

The interior 66 of the connector 64 may receive the sensor board 14, the first wall 86 and/or the second wall 88. As a result, the connector 64 may be adjacent to and/or may abut the device 12. The sensor board 14, the first wall 86 and/or the second wall 88 may be enclosed between the underside 26 of the device 12 and the exterior 68 of the connector 64. Further, the first window 78*a* and the second window 78*b* of the front side 70 of the connector 64 may align with the first LED 100 and/or the second LED 102, respectively on the front side 81 of the sensor board 14. As a result, the first LED 100 and/or the second LED 102 may emit light which may be visible through the first window 78*a* and the second window 78*b*, respectively, and/or may be visible from the exterior 68 of the connector 64.

Still further, the passages 76, 77 in the first end 72 of the connector 64 may align with the passages 89, 87, respectively, in the first wall 86 of the sensor board l4. A pin 104 may be inserted into the passages 76, 89 of the connector 64 and the sensor board 14, respectively. As a result, the connector 64 and/or the cable 14 may be attached and/or may be locked to the sensor board 14 and/or the device 12. The pin 104 may be, for example, a screw and/or the like. Moreover, the sensor board 14 and/or the device 12 may be attached to and/or may be locked to the base 16 and/or the fixture 48. The sensor board 14 may be connected to the alarm box 22, the alarm board 21, the first micro-controller 23 and/or the programmable power supplier 108. It should be understood that the pin 104 may be replaced with or used in conjunction with any fastener that are generally known and may be implemented by one having ordinary skill in the art.

The connector 64 may be attached to the sensor board 14 and/or the device 12 via the pin 104 and the passages 76, 89 of the connector 64 and the sensor board 14, respectively. As a result, the second micro-controller 94 of the sensor board 14 may be in communication with the first micro-controller 23 of the power supply board 18. Each of the plurality of heads 99 of the sensor board 14 may align with and/or may be connected to each of the plurality of heads 80 of the connector 64. Further, the plurality of heads 80, 99 may allow the second micro-controller 94 to communicate with the first micro-controller 23 via the cable 20 and/or the plurality of electrical wires 60. Still further, the second micro-controller 94 may communicate the required operational voltage of the device 12 to the first micro-controller 23 from the programmable power supplier 108 via the cable 20 and/or the plurality of electrical wires 60. As a result the first micro-controller 23 may adjust the output voltage of the programmable power supplier 108 to the required operational voltage of the device 12. Moreover, the programmable power supplier 108 may provide and/or may deliver the required operational voltage to the device and/or the output voltage to the second micro-controller 94 via the cable 20, the plurality of electrical wires 60, the voltage plug 98 and/or the DC plug-in 30.

The device 12 may, therefore, be activated with the required operational voltage provided from the programmable power supplier 108. The first LED 100 may be activated by the programmable power supplier 108 to indicate that the device 12 has been activated. The programmable power supplier 108 may activate the first LED 100 to indicate that the second micro-controller 94 may be receiving the output voltage from the power source 24 via the cable 20.

The optical sensor 96 may detect and/or may monitor the pin 104 extending through the passages 76, 89 of the connector 64 and the sensor board 14, respectively. The optical sensor 96 may indicate to the second micro-controller 94 of the sensor board 14 that the pin 104 is located within the passages 76, 89 of the connector 64 and the sensor board 14, respectively. Further, the second micro-controller 94 of the sensor board 14 may communicate the presence of the pin 104 to the first micro-controller 23 via the cable 20 and/or the plurality of electrical wires 60. As a result, the first micro-controller 23 may activate the alarm box 22 and/or the alarm board 21. The second micro-controller 94 and/or the first micro-controller 23 may activate the second LED 102 to indicate that the alarm box 22 has been activated. The second micro-controller 94 may be programmed to communicate with the optical sensor 96 and/or the first micro-controller 23. The optical sensor 96 may be programmed to detect the pin 104.

The second micro-controller 94 may be programmed to detect a signal from an external sensor 114. The external sensor 114 may transmit, for example, a radio signal to the second micro-controller 94. The second micro-controller 94 may communicate to the first micro-controller 23, the alarm box 22 and/or the alarm board 21 if the second micro-controller 94 has received the signal from the external sensor 114. The signal from the external sensor 114 may indicate that the second micro-controller 94 is within a radius, such as, for example, ten feet, twenty feet or thirty feet from the external sensor 114.

The optical sensor 96 may communicate to the second micro-controller 94 if the pin 104 is removed from the passages 76, 89 of the connector 64 and the sensor board 14, respectively. The second micro-controller 94 may signal the first micro-controller 23 if the pin 104 is removed from the passages 76, 89 of the connector 64 and the sensor board 14, respectively, via the cable 20 and/or the plurality of electrical wires 60. The first micro-controller 23 may trigger the alarm box 22 and/or the alarm board 21 if the pin 104 is removed from the passages 76, 89 As a result, the optical sensor 96 may be coupled to the alarm box 22 and/or the alarm board 21 via the cable 20, the plurality of electrical wires 60, the second micro-controller 94 and/or the first micro-controller 23. The optical sensor 96, the first micro-controller 23 and/or the second micro-controller 94 may electrically secure the device 12.

The device 12 may transmit a video signal to the second micro-controller 94 of the sensor board 14 via the video outline 31 of the device 12 and/or the video in-line 97 of the sensor board 14. The video in-line 97 and/or the voltage plug 98 may pass through passages 77, 87 of the connector 69 and the first wall 86 of the sensor board 14, respectively. The second micro-controller 94 and/or the first micro-controller 23 may store the video signal. The video signal may be, for example, a streaming video signal, a still video image and/or the like. The second micro-controller 94 of the sensor board 14 may communicate the video signal to the first micro-controller 23 via the cable 20 and/or the plurality of electrical wires 60. Further, the video signal may also have, for example, an audio signal. The second micro-controller 94 and/or the first micro-controller 23 may be programmed to store the video signal of the device 12 and/or to communicate the video signal.

The first micro-controller 23 may transmit the video signal from the device 12 to the video monitor 112, such as, for example, a television, a computer monitor and/or the like. In an alternative embodiment, the device 12 may transmit the video signal to the video monitor 112 via the video out-line 31, the plurality of electrical wires 60 and/or the cable 20. Still further, the video monitor 112 may be located adjacent to the device 12 and/or may be controlled by the first micro-controller 23. Moreover, the video monitor 112 may have, for example, audio speakers (not shown) to produce the audio signal transmitted from the device 12. The first micro-controller 23 may be programmed to transmit the video signal and/or the audio signal to the video monitor 112.

The sensor board 14 may be attached to the underside 26 of the device 12 via the fastener 92. Further, the video in-line 97 and the voltage plug 98 of the sensor board 14 may be inserted into the video out-line 31 and the direct current plug-in 30, respectively, of the device 12. The sensor board 14 may be inserted into the interior 66 of the connector 64. As a result, each of the plurality of heads 99 of the sensor board 14 may connect to each of the plurality of heads 80 of the connector 64, respectively. The second micro-controller 94 of the sensor board 14 may communicate the required operational voltage of the device 12 to the first micro-controller 23 of the power supply board 18 via the cable 20. The first micro-controller 23 may adjust the output voltage of the programmable power supplier 108 to the required operational voltage of the device 12 and/or may deliver the required operational voltage to the second micro-controller 94 and/or the device via the cable 20. The second micro-controller 94 and/or the programmable power supplier 108 may deliver the required operational voltage to the device 12 via the video in-line 97 and the DC plug-in 30.

The pin 104 may be inserted into passages 76, 89 of the connector 64 and the sensor board 14, respectively, to secure the sensor board 14 to the connector 64. The optical sensor 96 of the sensor board 14 may detect the pin 104 extending through the passage 89 of the sensor board 14. The optical sensor 96 may signal the second micro-controller 94 that the pin 104 is extending through the passage 87 of the sensor board 14. The second micro-controller 94 may communicate to the first micro-controller 23 that the pin 104 is extending through the passage 89. The first micro-controller 23 may activate the alarm box 22 and/or the alarm board 21. The first micro-controller 23 may communicate to the second micro-controller 94 that the alarm box 22 and/or the alarm board 21 has been activated. The second micro-controller 94 may activate the second LED 102 to indicate that the alarm box 22 and/or the alarm board 21 has been activated.

The optical sensor 96 may communicate to the second micro-controller 94 if the pin 104 has been removed from the passage 89 of the connector 64. The second micro-controller 94 may communicate to the first micro-controller 23 that the pin 104 has been removed from the passage 89. The second micro-controller 94 may deactivate the second LED 102 to indicate that the pin 104 has been removed from the sensor board 14. The first micro-controller 23 may trigger the alarm board 21 in the alarm box 22. The alarm board 21 may produce an audio signal which may indicate that the pin 104 has been removed from the sensor board 14 and/or that the device 12 is unsecured. The pin 104 may be replace in the passages 76, 89 of the connector 64 and the sensor board 14, respectively. As a result, the first micro-controller 23 may disengage the alarm board 21 which may stop the alarm board 21 from producing the audio signal.

The user and/or a customer may examine, may inspect and/or may utilize the device 12. The user may exert an outward force with respect to the base 16 on the device 12 and/or the end 58 of the cable 20. The movable end 42 and/or the pulley 52 of the base may move inward with respect to the fixed end 40 and/or the roller 54 along the interior 38 of the base 16. The outward force of the user may move the pulley 52 to a position which may be adjacent to the roller 54 of the base 16. As a result, the device 12 and/or the end 58 of the cable 20 may be separated from the base 16 by a distance corresponding to the length 46 of the base 16. The pulley 52 and/or the roller 54 may reduce friction along the cable 20 and/or may prevent damage to the cable 20 and/or the coating 63 of the cable 20. Further, the end 58 of the cable 20 may extend to, for example, three feet from the second opening 43 of the base 16. As a result, the user may move the device 12 allowing the user to examine and/or inspect the device 12 and/or functions provided by the device 12.

The user may examine and/or may inspect, for example, a weight of the device, a configuration of the device, a texture of an exterior of the device and/or the like. As a result, a user having a disability, such as, for example, being confined to a wheel chair may be permitted to examine and/or to inspect the device 12. Moreover, the device 12 may remain electrically and mechanically secured to the base 16, the alarm board 21, the alarm box 22 and/or the fixture 48 as the user examines and/or inspects the device 12. The user may activate and/or may utilize the device 12 to perform the functions provided by the device 12. For example, the device 12 may be a digital camera and the user may use the device 12 to perform the function of capturing an image (not shown in the drawings). As a result, the device 12 may display the image thereon and/or may transmit the image to the monitor 112. The user may examine and/or inspect the image captured by the device 12.

The user may return the device 12 and/or the end 58 of the cable 20 to a position which may be adjacent to the second opening 43 of the base 16. The movable end 42 may move outward with respect to the fixed end 40 of the base. The movable end 42 and/or the pulley 52 may move to a position adjacent to the second end 43 of the base 16. As a result, the movable end 42 and/or the pulley 52 may retract the device 12 and/or the cable 20 inward with respect to the exterior 36 of the base 16. Moreover, the movable end 42 and/or the pulley 52 may retract the device 12 and/or the end 58 of the cable 20 inward with respect to the exterior 36 of the base 16 to a position which may be adjacent to the exterior of the base 16.

The system 10 may secure the device 12 to the base 16 and/or the fixture 48 via the cable 20. Further, the system 10 may connect the device 12 to the alarm board 21, the alarm box 22 and/or the programmable power supplier 108 via the sensor board 14, the connector 64, the cable 20, the supply cable 56, the alarm connector 19 and/or the plurality of electrical wires 60. The second micro-controller 94 of the sensor board 14 may be in communication with the first micro-controller 23 via the connector 64, the cable 20 and/or the plurality of electrical wires 60. Still further, the device 12 may be monitored by the alarm box 22, the alarm board 21, the optical sensor 96, the second micro-controller 94, the external sensor 114, the pin 104, the cable 20 and/or the plurality of electrical wires 60. The second micro-controller 94 and/or the first micro-controller 23 may control the voltage delivered from the programmable power supplier 108 to the device 12. Moreover, the first LED 100 and/or the second LED 102 of the sensor board 14 may indicate that power is provided to the device 12 and/or that the alarm box 22 has been activated, respectively. The cable 20 and/or the base 16 may allow the device 12 to be manipulated, to be examined and/or to be utilized by a customer and/or a user. Furthermore, it should be understood that the first micro-controller 23 and/or the power supply board 18 may be in communication with more than one device 12, the first micro-controller 23, the second micro-controller 94, the sensor board 14, the base 16, the programmable power supplier 108 and/or the cable 20.

As illustrated by FIGS. 3 and 4, the alarm box 22, the alarm board 21 and/or the power source 24 may be connected to the plurality of second micro-controllers 94*a*, 94*b*, 94*c*, 94*d* via the first micro-controller 23. Each of the plurality of devices 12*a*, 12*b*, 12*c*, 12*d* may be in communication with the first micro-controller 23, the alarm box 22 and/or the alarm board 21 via the plurality of second micro-controllers 94*a*, 94*b*, 94*c*, 94*d*, respectively. The programmable power supplier 108 may be controlled by the first micro-controller and/or may provide the required operational voltage to each of the plurality of devices 12*a*, 12*b*, 12*c*, 12*d*. Each of the plurality of second micro-controllers 94*a*, 94*b*, 94*c*, 94*d* may have and/or may be in communication with the optical sensor 96. Each of the plurality of devices 12*a*, 12*b*, 12*c*, 12*d* may be in communication with and/or transmitting the video-signal to the monitor 112.

The optical sensor 96 of each of the plurality of second micro-controllers 94*a*, 94*b*, 94*c*, 94*d* may detect the pin 104. The optical sensor 96 may signal each of the plurality of second micro-controllers 94*a*, 94*b*, 94*c*, 94*d* that the pin 104 has been detected. The each of the plurality of second micro-controllers 94*a*, 94*b*, 94*c*, 94*d* may communicate to the first micro-controller 23 that the pin 104 has been detected. The first micro-controller 23 may activate the alarm box 22 and/or the alarm board 21. The first micro-controller 23 may communicate to the second micro-controller 94 that the alarm box 22 and/or the alarm board 21 has been activated. Each of the second micro-controller 94 may have the second LED 102. Each of the second micro-controllers 94*a*, 94*b*, 94*c*, 94*d* may activate the second LED 102 to indicate that the alarm box 22 and/or the alarm board 21 has been activated.

The optical sensor 96 may communicate to each of the plurality of second micro-controllers 94*a*, 94*b*, 94*c*, 94*d* if the pin 104 has been removed. Each of the plurality of second micro-controllers 94*a*, 94*b*, 94*c*, 94*d* may communicate to the first micro-controller 23 that the pin 104 has been removed. Each of the second micro-controller 94 may deactivate the second LED 102 to indicate that the pin 104 has been removed. The first micro-controller 23 may trigger the alarm board 21 in the alarm box 22. The alarm board 21 may produce an audio signal which may indicate that the pin 104 has been removed and/or that one of the plurality of devices 12*a*, 12*b*, 12*c*, 12*d* is unsecured. As a result, the first micro-controller 23 may disengage if the optical sensor 96 of each of the plurality of second micro-controllers 94*a*, 94*b*, 94*c*, 94*d* detects the pin 104. As a result, the first micro-controller 23 may signal the alarm board 21 to stop the alarm board 21 from producing the audio signal.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for securing a device, the apparatus comprising:

a connector having walls defining an interior wherein the connector attaches to the device;

a controller connected to the connector wherein the controller is within the interior of the connector and further wherein the controller is programmed to communicate with the device;

an optical sensor connected to and in communication with the controller wherein the optical sensor is connected to one of the walls of the connector wherein the optical sensor extends into the interior of the connector;

an alarm connected to and in communication with the controller wherein the optical sensor communicates with the alarm via the controller; and a pin sensed by the optical sensor wherein the pin extends through one of the walls of the connector into the interior of the connector wherein the optical sensor detects a position of the pin within the interior of the connector and activates the alarm in response to a change in the position of the pin within the interior of the connector.

2. The apparatus of claim 1 further comprising:

a light emitting diode in communication with the controller.

3. The apparatus of claim 1 further comprising:

a passage in the wall of the connector wherein the pin extends through the passage.

4. The apparatus of claim 1 further comprising:

a cable connecting the controller to the alarm.

5. A system for monitoring a device wherein the device is secured to a fixture, the system comprising:

a base having an interior;

a first controller attached to an alarm and a power source wherein the first controller communicates with the alarm and the power source wherein the first controller is programmed to control the alarm and the power source;

an attaching means having a length defined between a first end and a second end wherein the second end of the attaching means has a plurality of walls defining an interior wherein the attaching means connects the device to the first controller wherein the attaching means extends from the first controller through the base to the device wherein the first end of the attaching means is adjacent to the first controller wherein a wall of the plurality of walls at the second end of the attaching means has an opening extending through the wall into the interior of the second end of the attaching means wherein the attaching means provides electrical power from the power source to the device;

a pin having a length defined between a first end and a second end wherein the opening at the second end of the attaching means is sized to receive the pin wherein the pin extends from the opening into the interior of the attaching means; and a sensor detecting a condition of the first end of the pin within the interior of the attaching means between the sensor and the device wherein the sensor is attached to the second end of the attaching means via the pin wherein the sensor is located within the interior of the attaching means wherein the sensor activates the alarm via the first controller.

6. The system of claim 5 wherein the base is attached to the fixture.

7. The system of claim 5 wherein the attaching means is a cable.

8. The system of claim 5 further comprising: a pulley in the interior of the base.

9. The system of claim 5 further comprising:

a second controller connecting the device to the first controller.

10. The system of claim 5 further comprising:

a cable having a length defined between a first end and a second end wherein the first end of the cable is attached to the second end of the attaching means.

11. The system of claim 5 further comprising:

a monitor in communication with the device.

12. A method for monitoring a secured condition of a device wherein the device requires a first voltage, the method comprising the steps of:

providing a first controller having an alarm and a power source wherein the first controller is programmed to control the alarm and the power source wherein the power source provides a second voltage to the first controller;

providing a second controller which is electrically connected to the first controller and a sensor wherein the second controller is programmed to determine the first voltage required by the device wherein the second controller communicates the first voltage required by the device to the first controller wherein the first controller adjusts the second voltage provided by the power source to a voltage which corresponds to the first voltage determined by the second controller wherein the first controller transmits the second voltage to the second controller; and activating the alarm via the first controller wherein the second controller senses a breach of the secured condition and electrically signals the first controller that the breach of the second condition has been optically detected via the sensor.

13. The method of claim 12 further comprising the step of:

providing an external sensor to communicate with the second controller.

14. The method of claim 12 further comprising the step of:

providing a monitor in communication with the device.

15. The method of claim 12 further comprising the step of:

programming the second controller with the first voltage which is necessary to power the device.

16. The method of claim 12 further comprising the step of:

communicating the first voltage required to operate the device from the device to the first controller via the second controller.

17. The method of claim 12 further comprising the step of:

indicating that the second controller is in communication with the first controller.

18. The method of claim 12 further comprising the step of:

transmitting a signal from the device to the first controller.

19. A method for monitoring a secured condition of a device wherein the device requires a voltage, the method comprising the steps of:

providing a first controller having an alarm and a power source wherein the power source provides the voltage to the device;

providing a second controller that communicates with the device wherein the second controller provides the voltage to the device from the power source and further wherein the first controller is remotely positioned from the second controller;

activating the alarm wherein the second controller senses a breach of the secured condition and signals the first controller; and indicating that the second controller is in communication with the first controller.

* * * * *